US005536316A

United States Patent [19]

Schultz

[11] Patent Number: 5,536,316

[45] Date of Patent: Jul. 16, 1996

[54] APPARATUS FOR COATING AND CURING THE BOTTOM RIM SURFACE OF A CONTAINER

[75] Inventor: Robert H. Schultz, Golden, Colo.

[73] Assignee: Coors Brewing Company, Golden, Colo.

[21] Appl. No.: 325,036

[22] Filed: Oct. 18, 1994

[51] Int. Cl.[6] ..... B05B 1/00

[52] U.S. Cl. ..... 118/642; 118/58; 118/66; 118/239; 118/244; 118/258; 118/263; 118/DIG. 3

[58] Field of Search ..... 118/642, 58, 66, 118/239, 244, 258, 263, DIG. 3; 427/287, 428; 198/689.1; 101/40

[56] References Cited

U.S. PATENT DOCUMENTS

| | | | |
|---|---|---|---|
| 2,334,087 | 11/1943 | Goebel et al. | 118/DIG. 3 |
| 2,335,932 | 12/1943 | Gladfelter et al. | 118/DIG. 3 |
| 3,895,126 | 7/1975 | Strauss et al. | 118/66 |
| 4,136,767 | 1/1979 | Sarovich | 198/689.1 |
| 4,275,097 | 6/1981 | Shriver | 118/218 |
| 4,503,086 | 3/1985 | Schultz | 427/510 |
| 4,565,713 | 1/1986 | Schultz | 425/508 |
| 4,771,879 | 9/1988 | Shriver | 198/471.1 |
| 4,942,955 | 7/1990 | Shriver et al. | 198/471.1 |

*Primary Examiner*—Laura Edwards

*Attorney, Agent, or Firm*—Klaas, Law, O'Meara & Malkin; Joseph J. Kelly

[57] ABSTRACT

Apparatus for coating the bottom rim surface of a container using a vacuum conveyor for holding and transporting a plurality of empty containers with the bottom rim surfaces exposed so that the bottom rim surfaces may be passed over a coating applicator roll and through a curing oven to provide the bottom rim surfaces with a cured coating and wherein the vacuum conveyor is wide enough so that a plurality of the bottom rim surfaces may be coated at the same time and then passed through the curing oven.

12 Claims, 1 Drawing Sheet

APPARATUS FOR COATING AND CURING THE BOTTOM RIM SURFACE OF A CONTAINER

FIELD OF THE INVENTION

This invention is directed generally to the manufacture of containers and more particularly to providing the bottom rim surface of each container with a cured coating.

BACKGROUND OF THE INVENTION

In the manufacture of container body portions, it is sometimes desirable to provide the bottom rim surface of a container with a cured coating. In one type of apparatus for providing such a cured coating, a plurality of containers are supported on a vacuum conveyor with their exposed bottom surfaces located above the vacuum conveyor. The plurality of containers are in single file. The plurality of containers pass underneath a coating applying apparatus and then through a convection oven. While this apparatus does provide the bottom rim surfaces with a cured coating, it is slow and somewhat sloppy. In another type of apparatus, a plurality of containers are located in single file on a pin conveyor and are passed through a coating applying apparatus to apply a coating material to the bottom rim surfaces and then passed through a curing oven. If the coating material is an UV photoreactive coating material, the curing oven has a plurality of irradiator means for producing UV radiation to cure the UV photoreactive coating material.

BRIEF DESCRIPTION OF THE INVENTION

This invention provides apparatus for providing the bottom rim surface of a container with a cured coating wherein a plurality of containers are conveyed over a coating applicator with their bottom rim surfaces facing downwardly and then passed through a curing oven to cure the coating thereon.

In a preferred embodiment of the invention, the apparatus for providing the bottom rim surface of a container with a cured coating comprises a first conveyor for transporting a plurality of empty containers with the open ends thereof exposed and the bottom rim surfaces thereof in contact with the first conveyor which has an end portion and a second conveyor for transporting the plurality of empty containers from a first location to a second location. The first location comprises an end portion of the second conveyor superposed over the end portion of the first conveyor. Transfer means are provided for transferring the plurality of empty containers from the end portion of the first conveyor to the end portion of the second conveyor with the open ends in contact with the second conveyor and the bottom rim surfaces exposed. Coating means are provided for providing a coating material on the bottom rim surface of each of the plurality of empty containers. A curing means is provided and the second conveyor passes through the curing means to cure the coating material on the bottom rim surface of each of the plurality of empty containers. Collecting means are provided for collecting the plurality of cured bottom rim coated containers.

The coating means comprise a tank having a supply of coating material contained therein. An applicator roll having an outer peripheral surface is mounted on the tank for rotation relative thereto. Coating applying means are located in the tank for applying a desired amount of coating material on the outer peripheral surface. The applicator roll is located so that the coating material on the outer peripheral surface moves into contact with the bottom rim surface of each of the plurality of empty containers to apply the coating material thereto. First driving means are provided for moving the second conveyor in a predetermined direction and at a predetermined speed. Second driving means are provided for rotating the applicator roll so that the outer peripheral surface is moving in the same direction and at the same speed as the second conveyor when it contacts the bottom surface of each of the plurality of empty containers. The first and second driving means are drawn by the same motor. The outer surface is formed from an elastomeric material.

The transfer means comprise a vacuum source. The second conveyor passes over the vacuum source to pull each of the plurality of empty containers off of the end portion of the first conveyor and the open end into contact with the end portion of the second conveyor. The vacuum source functions to hold each of the plurality of empty containers in contact with the second conveyor as the second conveyor passes through the curing means. When the coating material comprises a UV photoreactive material, the curing means comprise a housing and a plurality of irradiator means located in the housing for producing UV radiation to cure the I/V photoreactive coating.

In a preferred embodiment of the invention, each of the first and second conveyors has a width at least equal to the combined diameters of at least three of the plurality of empty containers so that the applicator roll applies the coating material to the bottom rim surfaces of a plurality of the plurality of empty containers at the same time. The outer peripheral surface has a width at least substantially equal to the width of the second conveyor. The applicator roll is located so that the coating material on the outer peripheral surface moves into contact with the bottom rim surfaces of a plurality of the plurality of empty containers at the same time. The collecting means comprise a third conveyor for transporting the plurality of bottom rim surface coated empty containers with their open end exposed and the cured coated bottom end surfaces in contact with the third conveyor which have an end portion. The second location comprises another end portion of the second conveyor superposed over the end portion of the third conveyor. Another transfer means comprising a vacuum cut off means is provided for transferring the plurality of cured bottom rim surface coated empty containers from the another end portion to the end portion of the third conveyor. The third conveyor has a width substantially the same as the width of the first conveyor.

BRIEF DESCRIPTION OF THE DRAWINGS

An illustrative and presently preferred embodiment of the invention is illustrated in the drawing in which.

DETAILED DESCRIPTION OF THE INVENTION

Figure 2:
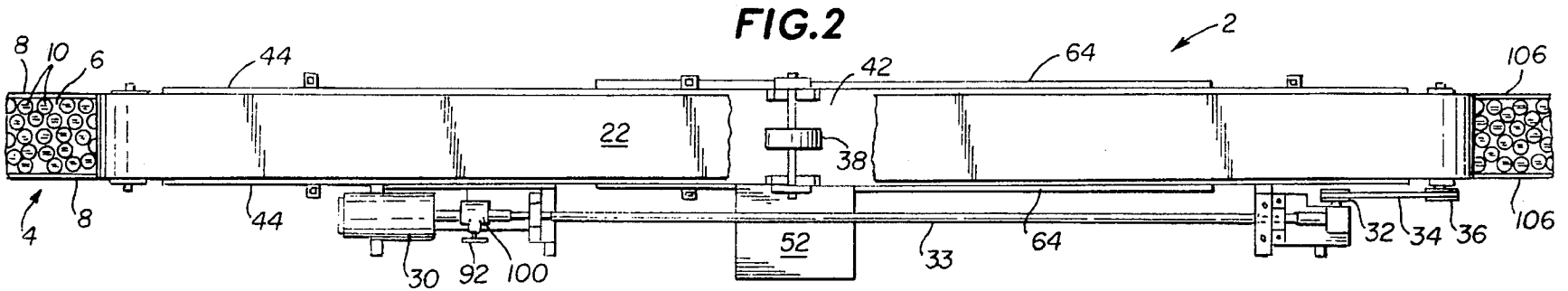
FIG. 2 is a top plan view of FIG. 1.
Figure 1:
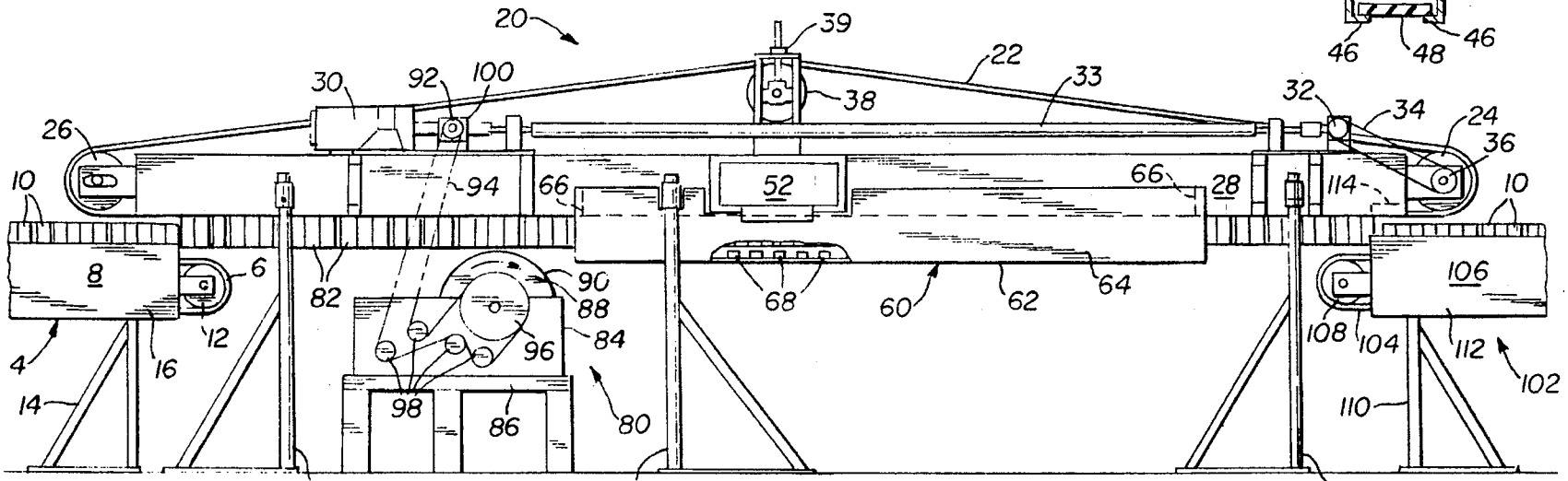
FIG. 1 is a side elevational view of an apparatus of this invention.

The apparatus 2 of this invention is illustrated in FIGS. 1 and 2. A first conveyor 4 has a conveyor belt 6 located between two opposite sidewalls 8. A plurality of empty containers 10 are carried by the conveyor belt 6 with the open ends of the containers 10 facing up. As illustrated in FIG. 2, the conveyor belt 6 is wide enough so that a plurality of containers 10 are located between the sidewalls 8. The conveyor belt 6 is trained around an idler roll 12. A drive roll, not shown, is located at the other end of the conveyor 4. The first conveyor 4 is mounted on fixed supports 14, only one of which is shown. The first conveyor 4 has an end portion 16 for a purpose described below.

Figure 3:
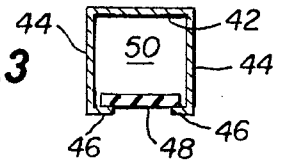
FIG. 3 is a view in cross-section of the vacuum chamber.

A second conveyor 20 has a fluid pervious conveyor belt 22 having a width that is the same as or slightly larger than the width of the conveyor belt 6. The conveyor belt 22 is journaled between a drive roll 24 and an idler roll 26, each of which is mounted on a housing 28. A motor 30 is mounted on the housing 28 and rotates a pulley 32 using conventional apparatus 33. A drive chain 34 is journaled around the pulley 32 and a pulley 36 that is connected to the drive roll 24 so that rotation of the pulley 36 rotates the drive roll 24. An idler roll 38 is adjustably mounted on the housing 28 by adjusting means 39 to adjust the tension in the conveyor belt 22. The housing 28 is mounted on a plurality of fixed supports 40. The housing 28 is illustrated in FIG. 3 and has a top wall 42, opposite sidewalls 44 and opposite flange portions 46 on which the lower reach 48 of the conveyor belt 22 slides. A vacuum is formed in the vacuum chamber 50 by a blower 52 mounted on the housing 28. If desired, wear strips formed from a suitable plastic material may be attached to the flange portions 46.

A curing oven 60 has a bottom wall 62, opposite sidewalls 64 and opposite end walls 66 that terminate at a location above the lower reach 48. The sidewalls 64 are secured to the sidewalls 44 by suitable means, such as bolts and nuts (not shown). A plurality of irradiator means 68 for producing UV radiation are mounted on the bottom wall 62.

In FIG. 1, there is located coating apparatus 80 for applying a coating material to the bottom rim surface 82 of each container 10. The coating apparatus 80 comprises a tank 84 for holding a supply of coating material (not shown) and which tank is mounted on a fixed support 86. The coating material preferably is a UV photoreactive coating material. A rubber applicator roll 88 is mounted for rotation in the tank 84 and conventional metering means (not shown) are provided to apply a desired amount of coating material to the peripheral outer surface 90 of the rubber applicator roll 88. The peripheral outer surface 90 has a width equal to or slightly greater than the width of the second conveyor belt 22. The rubber applicator roll 88 is rotated by drive means comprising a pulley 92 rotated by the motor 30 and a drive belt 94 journaled around pulley 96 connected to the rubber applicator roll 88 and tensioning pulleys 98. Therefore, rotation of the pulley 92 rotates the pulley 96 to rotate the rubber applicator roll 88. Control means 100 are provided to rotate the applicator roll 88 so that the outer peripheral surface 90 is moving at the same rate of speed and in the same direction as the lower reach 48 of the conveyor belt 22.

Collecting means are provided for collecting the containers 10 having a cured coating on the bottom rim surfaces 82 and comprise a third conveyor 102 having a conveyor belt 104 located between opposite sidewalls 106. The conveyor belt 104 has a width the same as or slightly less than the conveyor belt 22. The conveyor belt 104 is trained around an idler roll 108. A drive roll (not shown) is mounted at the other end of the conveyor belt 104. The third conveyor 102 is mounted on fixed supports 110, only one of which is shown. The third conveyor has an end portion 112 for a purpose described below. Vacuum cut-off means 114 are mounted on the sidewalls 44.

In operation, a plurality of empty containers 10 are fed onto the conveyor belt 6 so that several containers 10 are located between the sidewalls 8 with their open ends facing up. As the containers 10 reach the end portion 16, they are subjected to the vacuum in the vacuum chamber 50 and are transferred from the conveyor belt 6 to the lower reach 48 of the conveyor belt 22 which is formed from a fluid pervious material. The open ends of the containers 10 are in contact with the lower reach 48. The containers 10 move with the lower reach 48 and the bottom rim surfaces 82 move into contact with the outer peripheral surface 90 so that a layer of coating material is applied to the bottom rim surfaces. The lower reach 48 and the outer peripheral surface 90 are moving at the same speed and in the same direction when the coating material is being applied. The coating material preferably is an UV photoreactive coating material. The coated containers 10 move with the lower reach 48 into the curing oven 60 where they are subjected to the UV radiation produced by the irradiator means 68 to cure the UV photoreactive coating on the bottom rim surfaces 82. The containers 10 with the cured coated bottom rim surfaces 82 move with the bottom reach 48 out of the curing oven 60 until they reach the location that is superposed over the end portion 112. The vacuum cut-off means 114 cuts off the vacuum so that the containers 10 with the cured coated bottom rim surfaces 82 are transferred from the lower reach 48 onto the conveyor belt 104 to move with the conveyor belt 104 for further processing.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for providing a bottom rim surface of a container with a cured coating comprising:

a first conveyor for transporting a plurality of empty containers, each having an open end and a bottom rim surface, with said open ends thereof exposed and said bottom rim surfaces thereof in contact with said first conveyor; said first conveyor having an end portion;

a second conveyor for transporting said plurality of empty containers from a first location to a second location;

said first location comprising an end portion of said second conveyor superposed over said end portion of said first conveyor;

transfer means at said first location at said first location for transferring said plurality of empty containers from said end portion of said first conveyor to said end portion of said second conveyor with said open ends in contact with said second conveyor and said bottom rim surfaces exposed;

coating apparatus located beneath at least a portion of said second conveyor for providing a coating material on said bottom rim surface of each of said plurality of empty containers;

curing means located so that said second conveyor may pass therethrough;

said second conveyor passing through said curing means to cure said coating material on said bottom rim surface of each of said plurality of empty containers;

collecting means located at said second location for collecting said plurality of cured bottom rim coated containers;

said coating apparatus comprises;

a tank having a supply of coating material contained therein;

an applicator roll mounted on said tank for rotation relative thereto;

said applicator roll having an outer peripheral surface;

coating applying means in said tank for applying a desired amount of said coating material on said outer peripheral surface; and said applicator roll being located so that said coating material on said outer peripheral surface moves into contact with said bottom rim surface of each of said plurality of empty containers to apply said coating material thereto.

2. Apparatus as in claim 1 and further comprising:

first driving means connected to said second conveyor for moving said second conveyor in a predetermined direction and at a predetermined speed;

second driving means connected to said applicator roll for rotating said applicator roll so that said outer peripheral surface is moving in the same direction and at the same speed as said second conveyor when it contacts said bottom surface of each of said plurality of empty containers.

3. Apparatus as in claim 2 wherein:

said outer peripheral surface of said applicator roll is formed from an elastomeric material.

4. Apparatus as in claim 1 wherein said transfer means comprises:

a vacuum source;

said second conveyor passing over said vacuum source to pull each of said plurality of empty containers off of said end portion of said first conveyor and said open end into contact with said end portion of said second conveyor; and said vacuum source holding each of said plurality of empty containers in contact with said second conveyor as said second conveyor passes over said applicator roll and through said curing means.

5. Apparatus as in claim 1 wherein said curing means comprises:

a housing;

said coating material comprises a UV photoreactive coating; and a plurality of irradiator means located in said housing for producing UV radiation to cure said UV photoreactive coating.

6. Apparatus as in claim 5 wherein said transfer means comprises:

a vacuum source;

said second conveyor passing over said vacuum source to pull each of said plurality of empty containers off of said end portion of said first conveyor and said open end into contact with said end portion of said second conveyor; and said vacuum source holding each of said plurality of empty containers in contact with said second conveyor as said second conveyor passes over said applicator roll and through said curing means.

7. Apparatus as in claim 1 wherein:

each of said first and second conveyors having a width at least equal to the combined diameters of at least three of said plurality of empty containers so that said applicator roll applies said coating material to said bottom rim surfaces of a plurality of said plurality of empty containers at the same time.

8. Apparatus as in claim 7 wherein said transfer means comprises:

a vacuum source;

said second conveyor passing over said vacuum source to pull each of said plurality of empty containers off of said end portion of said first conveyor and said open end into contact with said end portion of said second conveyor; and said vacuum source holding each of said plurality of empty containers in contact with said second conveyor as said second conveyor passes over said applicator roll and through said curing means.

9. Apparatus as in claim 7 wherein said curing means comprises:

a housing;

said coating material comprises a UV photoreactive coating; and a plurality of irradiator means located in said housing for producing UV radiation to cure said UV photoreactive coating.

10. Apparatus as in claim 1 wherein said collecting means comprises:

a third conveyor for transporting said plurality of bottom rim surface coated empty containers with their open end exposed; said third conveyor having an end portion;

an opposite end portion of said second conveyor superposed over said end portion of said third conveyor;

another transfer means for transferring said plurality of cured bottom rim surface coated empty containers from said opposite end portion to said end portion of said third conveyor; and said third conveyor having a width substantially the same as said width of said first conveyor.

11. Apparatus as in claim 10 wherein said curing means comprises:

a housing;

said coating material comprises a UV photoreactive coating; and a plurality of irradiator means located in said housing for producing UV radiation to cure said UV photoreactive coating.

12. Apparatus as in claim 10 wherein said transfer means comprises:

a vacuum source;

said second conveyor passing over said vacuum source to pull each of said plurality of empty containers off of said end portion of said first conveyor and said open end into contact with said end portion of said second conveyor; and said vacuum source holding each of said plurality of empty containers in contact with said second conveyor as said second conveyor passes over said applicator roll and through said curing means; and said another transfer means comprise vacuum cut-off means for cutting off said another end portion from said vacuum source.

* * * * *